US007284370B2

(12) United States Patent
Tatsukawa

(10) Patent No.: US 7,284,370 B2
(45) Date of Patent: Oct. 23, 2007

(54) POSITIONING CONTROL APPARATUS

(75) Inventor: Hirofumi Tatsukawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 944 days.

(21) Appl. No.: 10/202,097

(22) Filed: Jul. 25, 2002

(65) Prior Publication Data

US 2003/0140624 A1 Jul. 31, 2003

(30) Foreign Application Priority Data

Jan. 25, 2002 (JP) ..... 2002-017193

(51) Int. Cl.
*F01N 7/00* (2006.01)

(52) U.S. Cl. ..... 60/324; 251/129.01; 251/129.04; 700/44; 700/282

(58) Field of Classification Search ..... 60/274, 60/324; 123/323; 137/1; 251/129.01, 129.04, 251/129.05, 129.02, 129.03; 700/44, 282
See application file for complete search history.

(56) References Cited

U.S. PATENT DOCUMENTS 4,112,885 A * 9/1978 Iwata et al. ..... 251/129.04
4,726,389 A * 2/1988 Minoura et al. ..... 137/1
5,161,777 A * 11/1992 Kawasaki et al. ..... 251/129.04
5,551,480 A * 9/1996 Tomatsu et al. ..... 251/129.05
5,769,390 A * 6/1998 Ando ..... 251/129.05
5,924,435 A * 7/1999 Wall et al. ..... 137/1
6,098,644 A * 8/2000 Ichinose ..... 137/1
6,394,414 B1 * 5/2002 Breitling et al. ..... 251/129.04
6,427,971 B1 * 8/2002 Kawabe et al. ..... 251/129.04

FOREIGN PATENT DOCUMENTS

JP 05-332191 A 12/1993
JP 07-314287 A 12/1995
JP 09-317548 A 12/1997

* cited by examiner

*Primary Examiner*—Tu M. Nguyen
(74) *Attorney, Agent, or Firm*—Sughrue Mion Pllc.

(57) ABSTRACT

A positioning control apparatus includes a position detector 102 which detects the position of a positioning object 101, a target position generator 103 which generates a target position signal based on an output from the position detector, and a driving unit 104 which drives the positioning object based on an output from the target position generator. The target position generator 103 includes a control unit which sets a temporary target position of the positioning object and performs the learning of a reference position of the positioning object. A control gain given to the driving unit includes a first control gain, which is valid until the positioning object reaches the set temporary target position, and a second control gain, which is smaller than the first control gain and which is valid after the time when the positioning object has reached the temporary target position until the reference position learning is completed.

10 Claims, 8 Drawing Sheets

POSITIONING CONTROL APPARATUS

This application is based on Application No. 2002-17193, filed in Japan on Jan. 25, 2002, the contents of which are hereby incorporated by reference.

BACKGROUND OF THE INVENTION

1. Field of the Invention

The present invention relates to a positioning control apparatus having a reference position learning function, and more particularly, it relates to a positioning control apparatus having a reference position learning function so as to improve control accuracy without being influenced by aged deterioration, mounting conditions, etc.

2. Description of the Related Art

Conventionally, there has been known a device capable of performing reference position learning in a positioning control apparatus having a position sensor such as a potentiometer, as described in Japanese Patent Application Laid-Open No. 5-332191 entitled "Throttle Reference Opening Detection Device", for example. This device learns a reference position in order to prevent the deterioration of control accuracy due to mounting play or clearances in driving parts and a position sensor, the extension of a wire in case of an actuator using the wire, etc.

In the reference position learning, a fixed stopper is installed at a position which becomes a reference, and a positioning control object, i.e., an object whose position is to be controlled, is continuously driven to move in a direction toward the fixed stopper until it is placed into abutment with the stopper. The reading of a position sensor when the positioning object becomes unable to move any more is learned as a reference position.

Even with a change in the mounting state of the position sensor, it is always possible to detect the accurate position of the positioning object from the reference position by converting, through calculations, the output value or reading of the position sensor into a relative position with respect to the reference position. Accordingly, by performing accurate positioning control using the relative position, it becomes possible to carry out the positioning control in an accurate manner.

The positioning control apparatus having the conventional reference position learning function as shown in the above-mentioned publication determines the reference position by bringing the positioning object into abutment against the stopper in the reference position learning. The positioning object might not be able to be driven to move in the direction of the stopper by some reasons. For instance, in cases where the positioning object is unable to be temporarily driven, upon starting of its operation, in a direction toward the stopper due to causes such as biting of foreign matter, carbon clinging, etc., the initial position of the positioning object is learned as a reference position even if the initial position is far away from an original or inherent reference position. As a result, the following positioning control might be influenced harmfully.

Moreover, it is general to set a relatively large control gain in the positioning control so that the positioning object can reach a target position as quickly as possible. That is, a driving force for driving the positioning object is often set to a large value. In such a condition in which the driving force is large, if the target position for positioning control is set at a location at which the positioning object is unable to reach the stopper even when it overruns the target position (e.g., the stopper position may be set at a location within a movable range and outside an area in which the positioning target is usually set.), there will be no necessity for considering damage to a driving mechanism such as a motor, gearing and the like for driving the positioning object, due to an impact which would otherwise be generated when the positioning object is placed into abutment against the stopper. However, the abutment of the positioning object against the stopper is indispensable for the reference position learning, and hence there will be damage to the driving mechanism due to an impact caused by the abutment of the positioning object against the stopper.

SUMMARY OF THE INVENTION

In view of the above, the present invention is intended to provide a positioning control apparatus in which a positioning object is able to quickly reach a temporary target position set for positioning control, and which is capable of preventing a mechanism for driving the positioning object from being damaged when reference position learning is carried out after the positioning object has reached the temporary target position.

Bearing the above object in mind, the present invention resides in a positioning control apparatus which includes: a position detector for detecting the position of a positioning object; a target position generator for generating a target position signal based on an output from the position detector; and a driving unit for driving the positioning object based on an output from the target position generator. The target position generator includes a control unit for setting a temporary target position of the positioning object, and learning a reference position of the positioning object with a control gain given to the driving unit. The control gain includes a first control gain, which is valid until the time when the positioning object reaches the set temporary target position, and a second control gain, which is smaller than the first control gain and which is valid after the time when the positioning object has reached the temporary target position until the reference position learning is completed.

With this arrangement, by using the first control gain to provide a large driving force, it is possible for the positioning object to reach the temporary target position as quickly as possible from the turning on of the power supply, thereby reducing the time required for completing the reference position learning, whereas by using the second gain to provide a small driving force, the impact caused when the positioning object is brought into abutment against a stopper during the reference position learning can be reduced, thereby making it possible to prevent damage to the positioning control apparatus.

The above and other objects, features and advantages of the present invention will become more readily apparent to those skilled in the art from the following detailed description of preferred embodiments of the present invention taken in conjunction with the accompanying drawings.

BRIEF DESCRIPTION OF THE DRAWINGS

FIG. 8 is an explanatory view showing a positional change in the case where a positioning object has reached a temporary target position but is unable to be driven any more when a power supply is turned on.

DESCRIPTION OF THE PREFERRED EMBODIMENTS

Hereinafter, preferred embodiments of the present invention will be described in detail while referring to the accompanying drawings.

Figure 1:
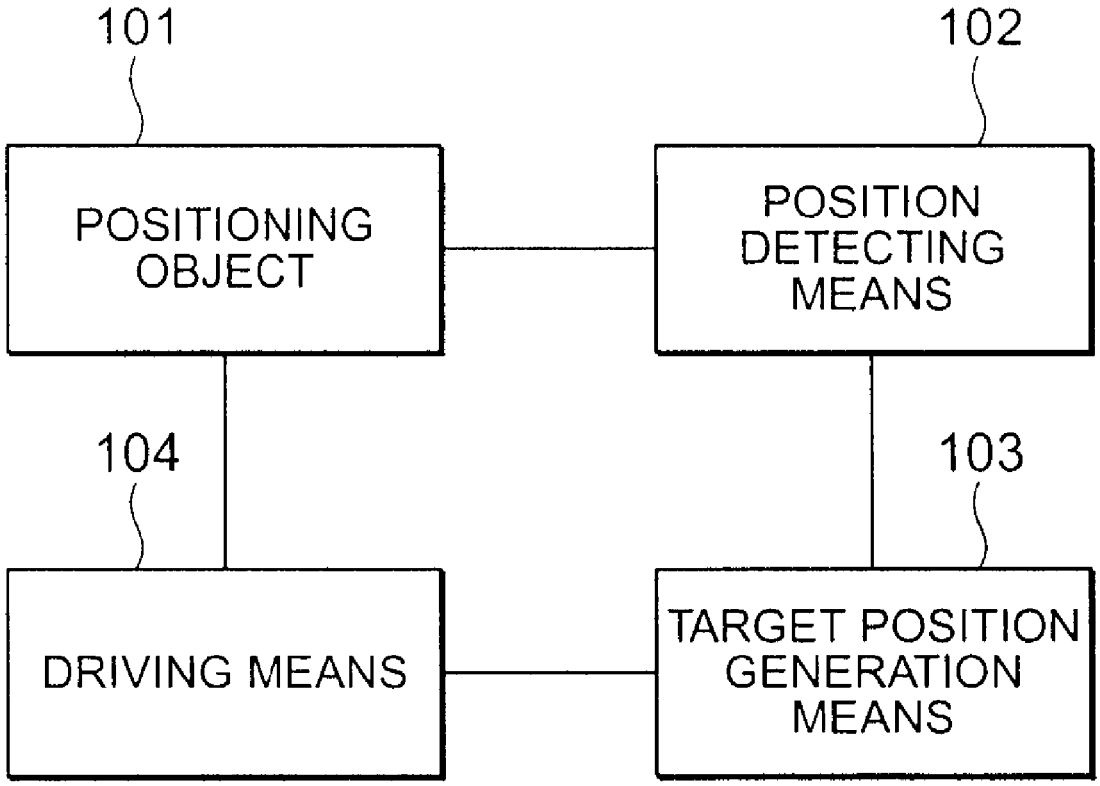
FIG. 1 is a block diagram showing a positioning control apparatus according to an embodiment of the present invention.

FIG. 1 is a functional block diagram of a positioning control apparatus according to an embodiment of the present invention. The positioning control apparatus illustrated in FIG. 1 includes a position detecting means 102 such as a position detector for detecting the position of a positioning object 101 and generating a corresponding position signal, a target position generation means 103 such a target position generator for generating a target position signal based on the position signal output from the position detecting means 102, and a driving means 104 such as a driving unit for driving the positioning object 101 based on the output from the target position generation means 103. The target position generation means 103 includes a control means such as a control unit for performing the learning of a reference position of the positioning object 101. The control means operates to set a control gain given to the driving means 104 in such a manner that the control gain takes a first control gain until the positioning object 101 reaches a set temporary target position, and a second target gain, which is less than the first control gain, from or after the time when the positioning object 101 has reached the temporary target position until the time when the reference position learning is completed.

Figure 2:
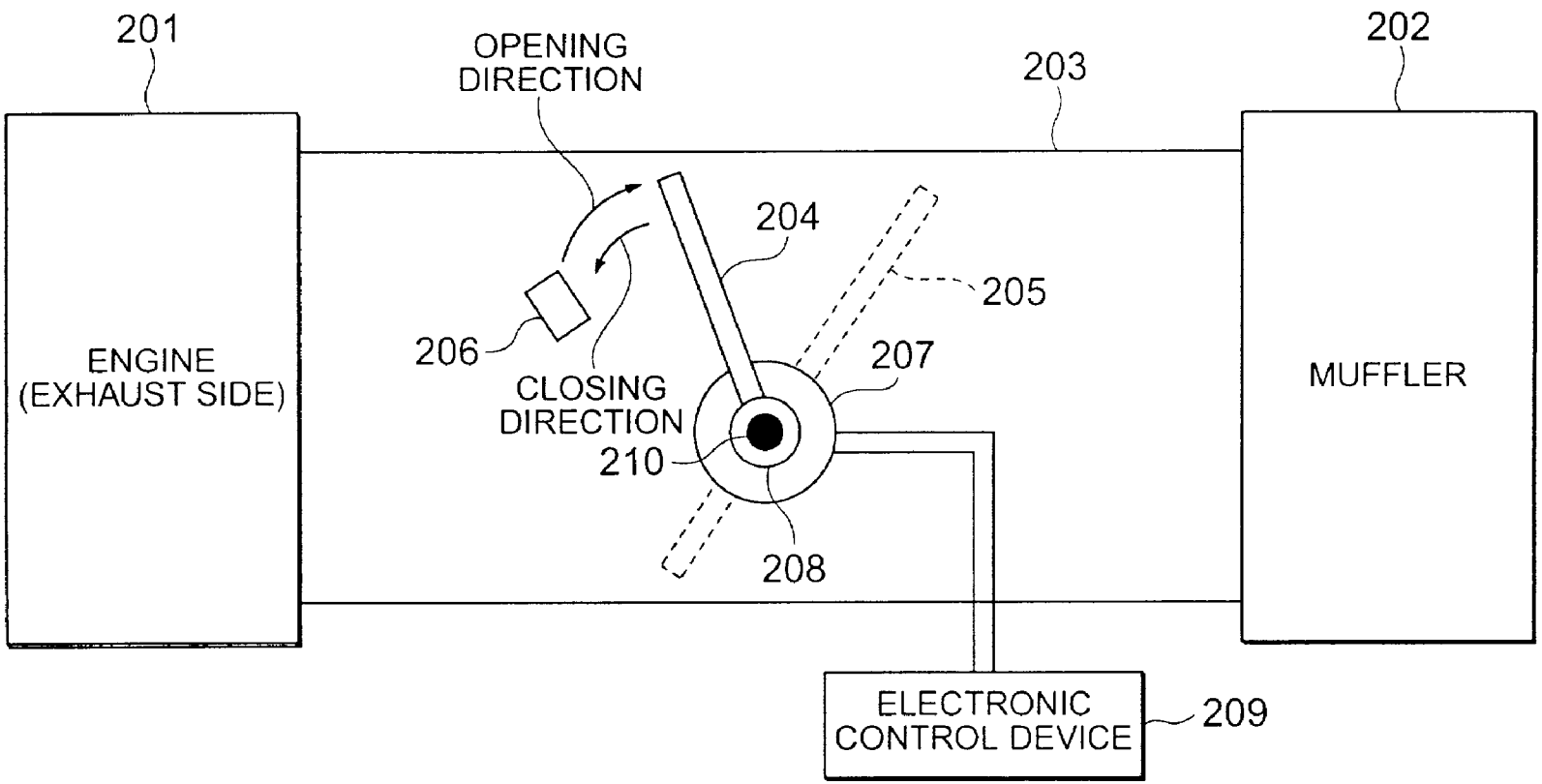
FIG. 2 is a schematic constructional view showing a valve drive unit provided with a positioning control apparatus having a reference position learning function, which is constructed by applying the present invention.

FIG. 2 is a schematic constructional view showing a valve drive unit which is arranged on exhaust piping of an engine and provided with a positioning control apparatus having a reference position learning function, to which the present invention is applied. An engine 201 installed on a motor vehicle or the like discharges combustion gases from an exhaust port, which are exhausted from a muffler 202 to the ambient atmosphere through an exhaust pipe or piping 203. In the valve drive unit, a drivable valve 205 is installed in the exhaust pipe 203 as the positioning object 101. The valve 205 is driven to adjust the exhaust pressure of the combustion or exhaust gases thereby to control the output power of the engine 201. The valve drive unit includes the engine 201, the muffler 202, the exhaust pipe 203, a stopper abutment portion 204, the valve 205, a stopper 206, a motor 207 as the driving means 104, a position sensor 208 as the position detecting means 102, an electronic control unit 209 as the target position generation means 103, and a drive shaft 210.

The valve 205 is installed in the exhaust pipe 203, and it is a control object that is subjected to positioning control. The stopper abutment portion 204 is arranged outside the exhaust pipe 203 and operatively connected with the valve 205 and the motor 207 by means of the drive shaft 210. The motor 207 is driven by a control command current output from the electronic control unit 209 to adjust the position of the valve 205.

The position sensor 208 comprises a potentiometer which is mounted directly on the stopper abutment portion 204 or indirectly on the motor 207 or the like for converting the absolute position of the valve 205 into an electric signal to be output. The electronic control unit 209 calculates a target position of the valve 205 based on inputs from the position sensor 208, other various sensors and switches through prescribed processing, and outputs a corresponding control command current to the motor 207 based on the thus calculated target valve position.

An individual difference might be generated in the position of the valve 205 owing to the mounting states of the valve 205 and the position sensor 208. Accordingly, in order to perform accurate position control, reference position learning is carried out to calculate a reference position, whereby the positioning control is performed by using the relative position of the valve 205 with respect to the reference position. In the reference position learning, the stopper abutment portion 204 is driven in a direction to close the valve 205, so that the stopper abutment portion 204 is placed into abutment against the stopper 206. As a result, the output of the position sensor 208 becomes unchanged, and the output value or reading of the position sensor at this time is learned as the reference position.

Figure 3:
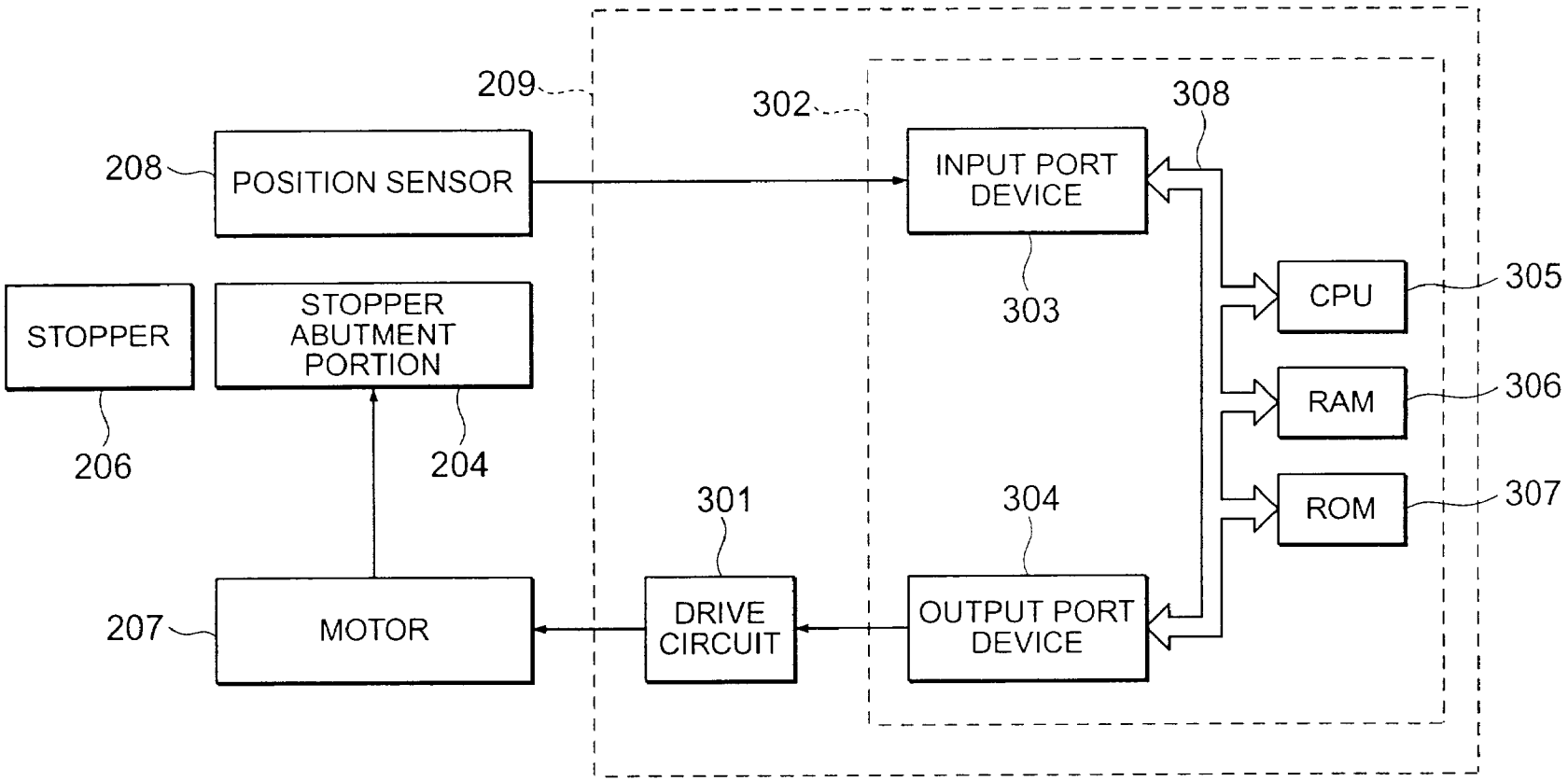
FIG. 3 is a block diagram showing details of an electronic control unit of the present invention shown in FIG. 2.

FIG. 3 is a block diagram which shows the detailed construction inside the electronic control unit 209. The electronic control unit 209 includes a driving circuit 301 and a microcomputer 302 as the control means, as shown in FIG. 3. A control command current signal calculated by the microcomputer 302 is input to the driving circuit 301 which in turn outputs a corresponding control command current to the motor 207. The microcomputer 302 includes an input port device 303, an output port device 304, a CPU 305, a RAM 306, and a ROM 307, all of which are mutually connected with each other by a bilateral common bus 308.

The position signal output from the position sensor 208 is input to the input port device 303, which properly processes the input signal. The signal thus processed is output to the CPU 305 and the RAM 306 according to an instruction of the CPU 305 based on a control program stored in the ROM 307. The output port device 304 outputs a control command current to the motor 207 through the driving circuit 301 according to an instruction of the CPU 305.

Figure 4:
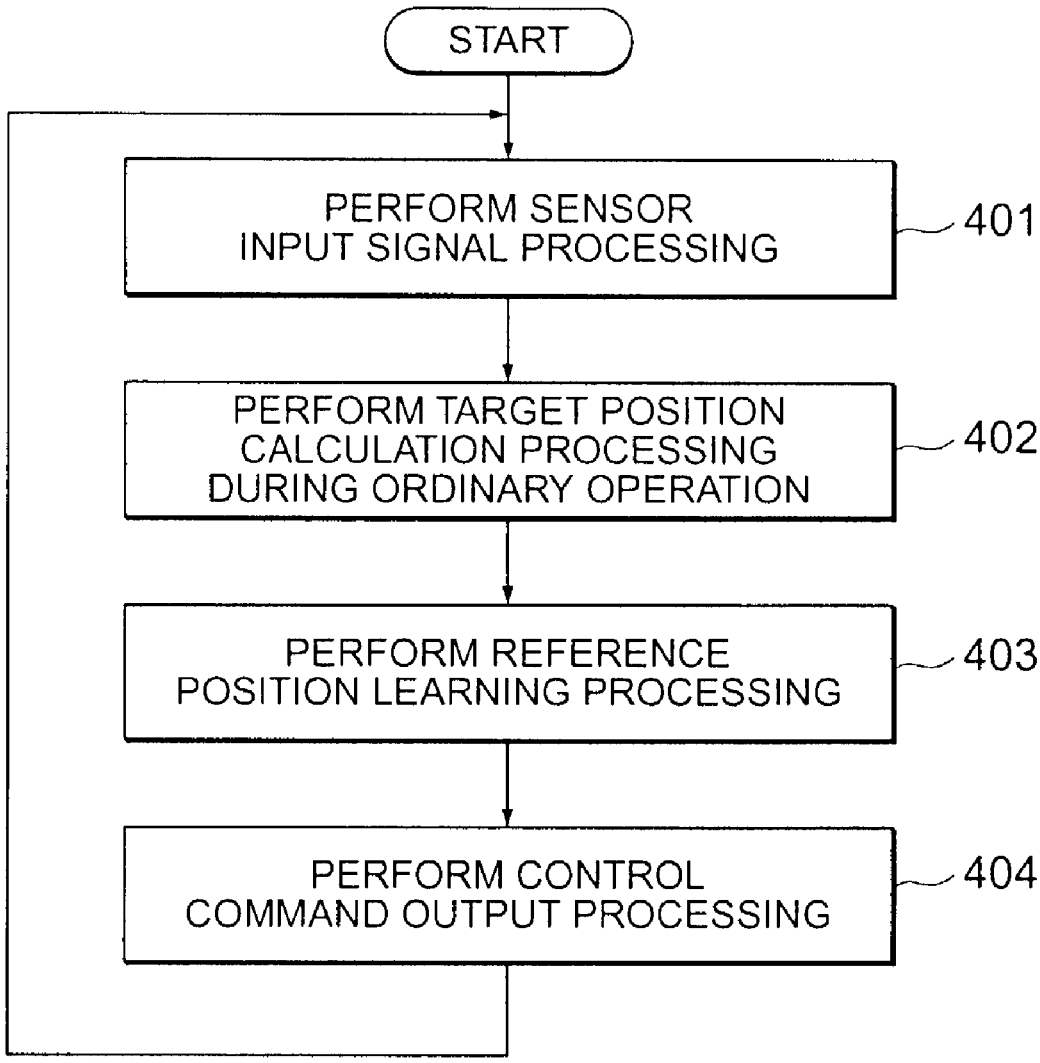
FIG. 4 is a flow chart showing a control procedure of the electronic control unit of the present invention shown in FIG. 3.

The CPU 305 processes various operational calculations and signals based on the control program stored in the ROM 307, as shown in FIG. 4. When energized, the RAM 306 temporarily stores therein variables, etc., based on the control program shown in FIG. 4.

Next, the flow of control in the present invention achieved by the microcomputer 32 will be described below while referring to a flow chart shown FIG. 4. When the power supply is turned on to supply electric power to the electronic control unit 209, the microcomputer 34.302 reads in the control program stored in the ROM 307. Subsequently, a counter and a flag set in the RAM 306 are initialized, and processing is started from step 401. In step 401, respective output signals of the position sensor 208 and other sensors connected with the electronic control unit 209 are input to the CPU 305 through the input port device 303.

Then, in step 402, processing is carried out to calculate a target position for ordinary operation based on the respective signals input in step 401. In step 403, reference position learning processing is performed based on a position signal input from the position sensor 208 in step 401. When the reference position learning has already been completed, the target position calculated in step 402 is calculated as a final target position. On the other hand, when the reference position learning has not yet been completed, the learning processing is performed while keeping driving the stopper abutment portion 204 in the direction of the stopper 206. When the learning has not been completed even if a prescribed period of time is elapsed, the learning is compulsorily ended. A detailed explanation of the reference position learning processing will be described later.

In step 404, the final target position is converted into a corresponding control command current value for driving the motor 207, so that the target position becomes the final target position calculated in step 403. The control command current value thus obtained is output to the driving circuit 301 through the output port device 304. Thereafter, a return to step 401 is again performed, thus continuing the processing.

Figure 5:
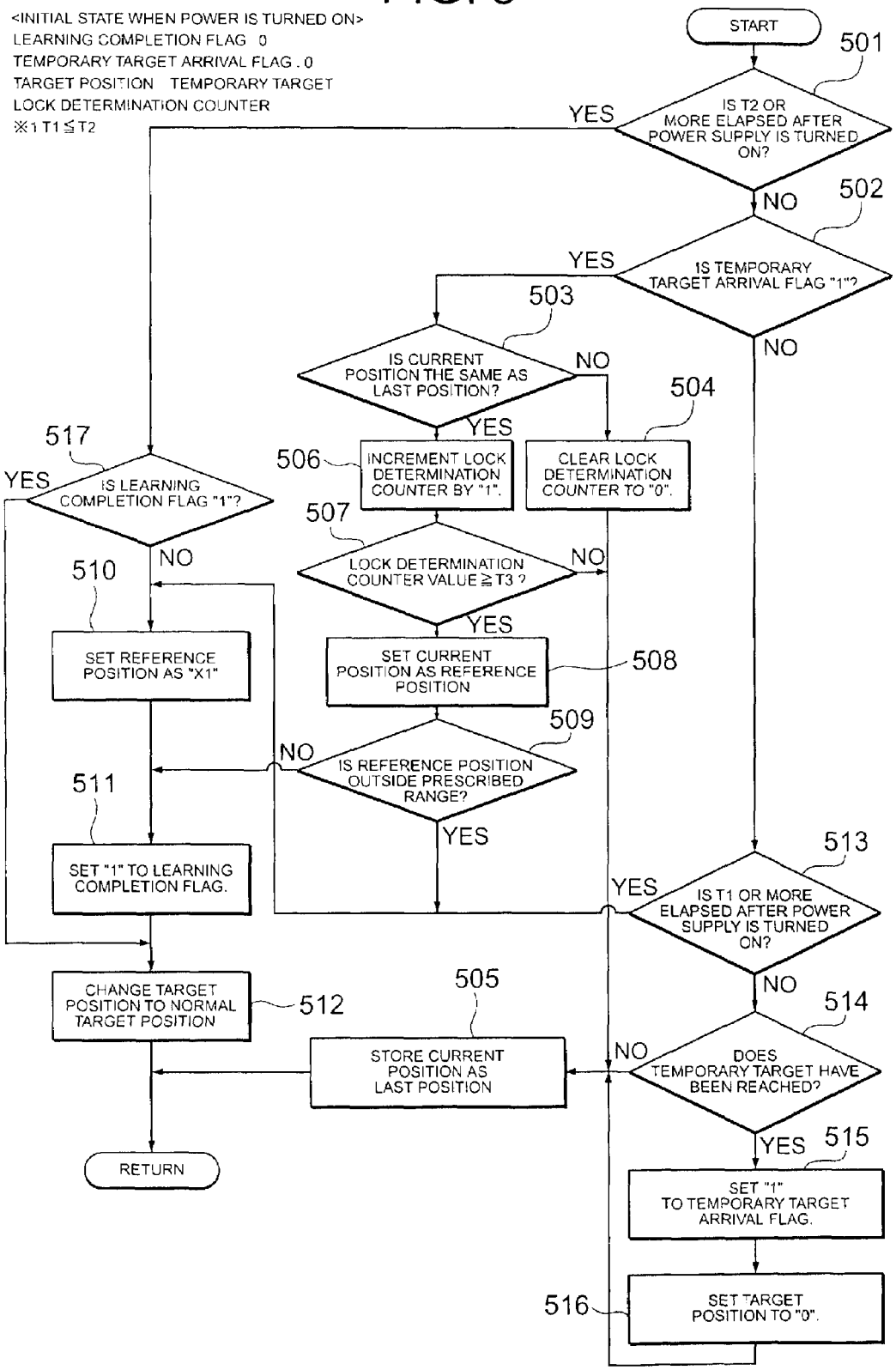
FIG. 5 is a flow chart showing details of reference position learning processing shown in FIG. 4.
Figure 6:
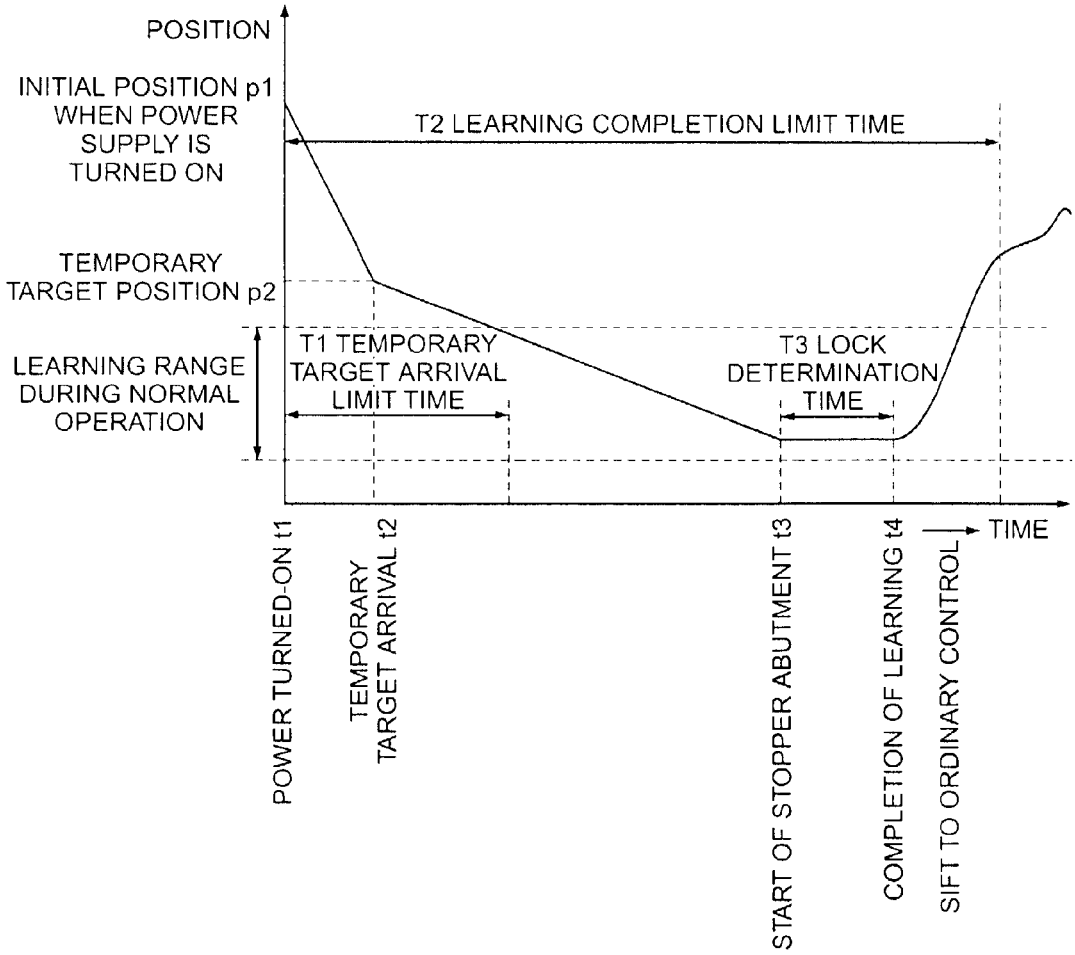
FIG. 6 is an explanatory view showing a positional change when the reference position learning is completed normally.

Turning to FIG. 5, this figure is a flow chart which shows details of the reference position learning processing carried out in step 403 as shown in FIG. 4. Now, the reference position learning processing will be explained below while referring to FIG. 6, which shows a positional change when the reference position learning is completed normally. First of all, a temporary target position p2 is set as a target position even if the initial position p1 of the positioning object 101 is in any place immediately after the power supply is turned on (at time point t1). Then, the process of learning the reference position of the positioning object 101 (the valve 205) is carried out with a control gain being given to the motor 207 through the driving circuit 301. The control gain includes a first control gain, which is valid or effective until a set temporary target position is reached (at time point t2), and a second control gain of a value less than that of the first control gain, which is valid or effective from the time when a second initial target position is reached to the time when the reference position learning processing is completed (i.e., from time point t2 to time point t4). When the temporary target position p2 is reached within a temporary target arrival limit time or duration T1 (at time point t2), the positioning object 101 is driven to move in a direction (i.e., in a closing direction) to abut against the stopper 206, as shown in FIG. 2. At this time, the positioning object 101 is driven by a limited force so as not to damage both the motor 207 and the stopper abutment portion 204 by the abutment of the positioning object 101 against the stopper 206.

The stopper abutment portion 204 begins to abut against the stopper 206 within a learning completion limit time or duration T2 (at time point t3). If the state in which the output of the position sensor 208 does not change continues for a lock determination time or duration T3, the current position of the stopper abutment portion 204 is learned as a reference position and the learning is completed (at time point t4). Thereafter, control is shifted to the ordinary control. The "temporary target" of the target position is set for the purpose of confirming that the reference position learning becomes valid or effective. The target position of the valve 205 is set to the "temporary target" position before the reference position learning through the abutment thereof against the stopper 206 is started. When the valve 205 reaches the "temporary target" position, it is determined that the valve 205 is operating normally. In other words, if the valve 205 is unable to reach the "temporary target" position after the power supply is turned on, it is considered that there may be some abnormality in an environment where the valve 205 is driven to move. Thus, it will be evident that it is impossible to calculate a correct reference position even if the reference position learning is carried out in such a condition. Therefore, control is performed by using a preset reference position which was set beforehand.

Figure 7:
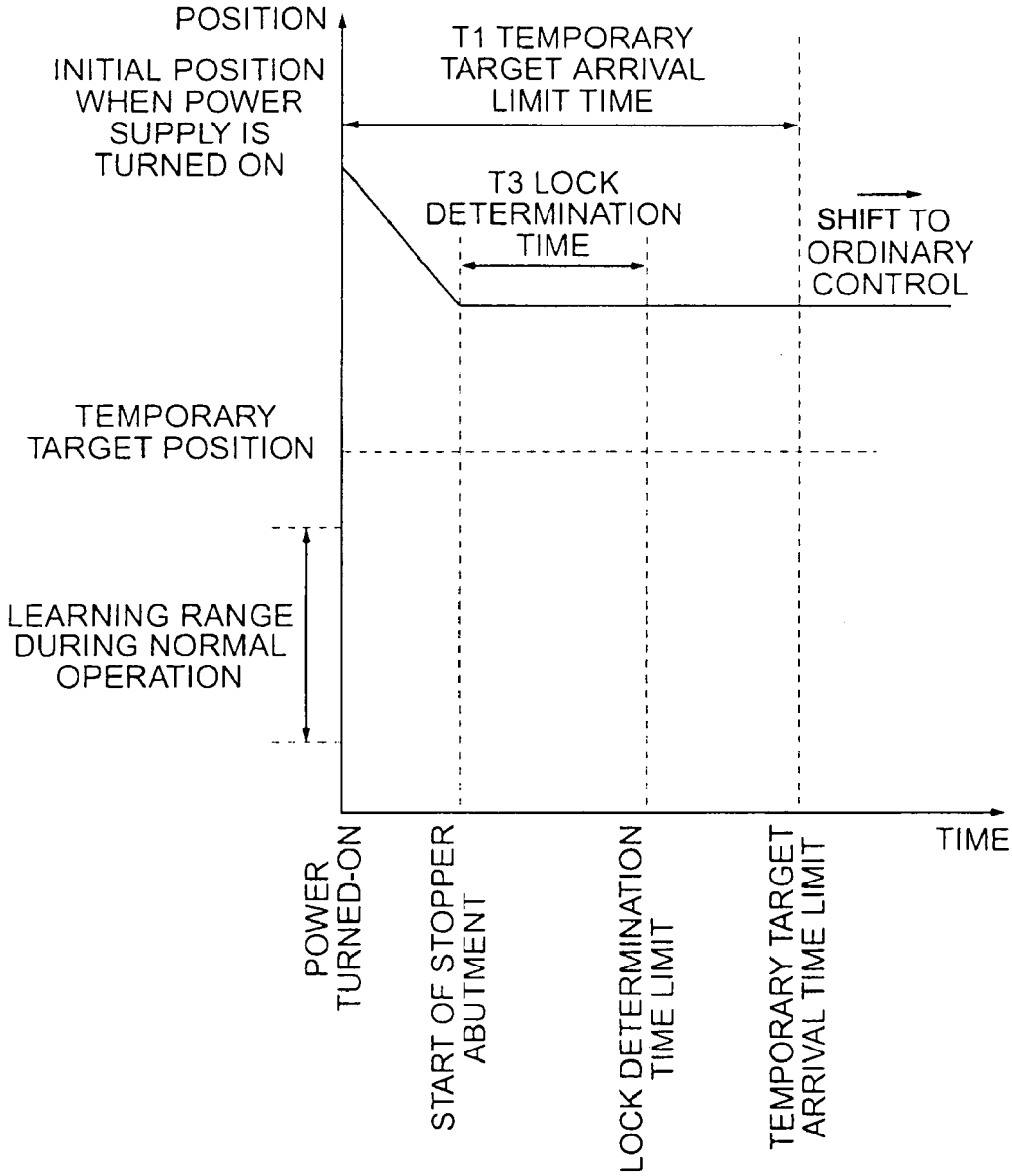
FIG. 7 is an explanatory view showing a positional change when a temporary target position has not yet been reached.

A positional change when the temporary target position can not be reached is shown in FIG. 7. After the power supply is turned on (at time point t1), the valve 205 is driven to move from the initial position p1 thereof to the temporary target position p2. At this time, when the valve 205 becomes unable to be driven any more at a certain position before it reaches the temporary target position for some reasons, according to the prior art, the position at which the valve 205 is stopped is assumed to be a reference position and wrong learning is carried out. In contrast to this, according to the present invention, in order to check whether the valve driving environment is normal, it is determined whether the valve 205 has reached the temporary target position, and only after it is determined that the valve driving environment is normal, the reference position learning is performed. Though details will be described later, if the temporary target has not yet been reached even when the temporary target arrival limit time T1 has elapsed, the reference position learning is compulsorily completed or ended, and the preset position is set as a reference position.

However, when the valve 205 has reached the "temporary target" position in the initial state thereof after the power supply is turned on, the valve driving environment is determined to be normal even if there is abnormality in the operating condition of the valve 205. Thus, in order to cope with such a problem, the "temporary target" position is set to a location "outside a prescribed range", and, if the reference position calculated by the reference position learning is "outside the prescribed range", it is determined that the reference position learning is invalid. As a result, control is carried out by using the preset reference position.

Figure 8:
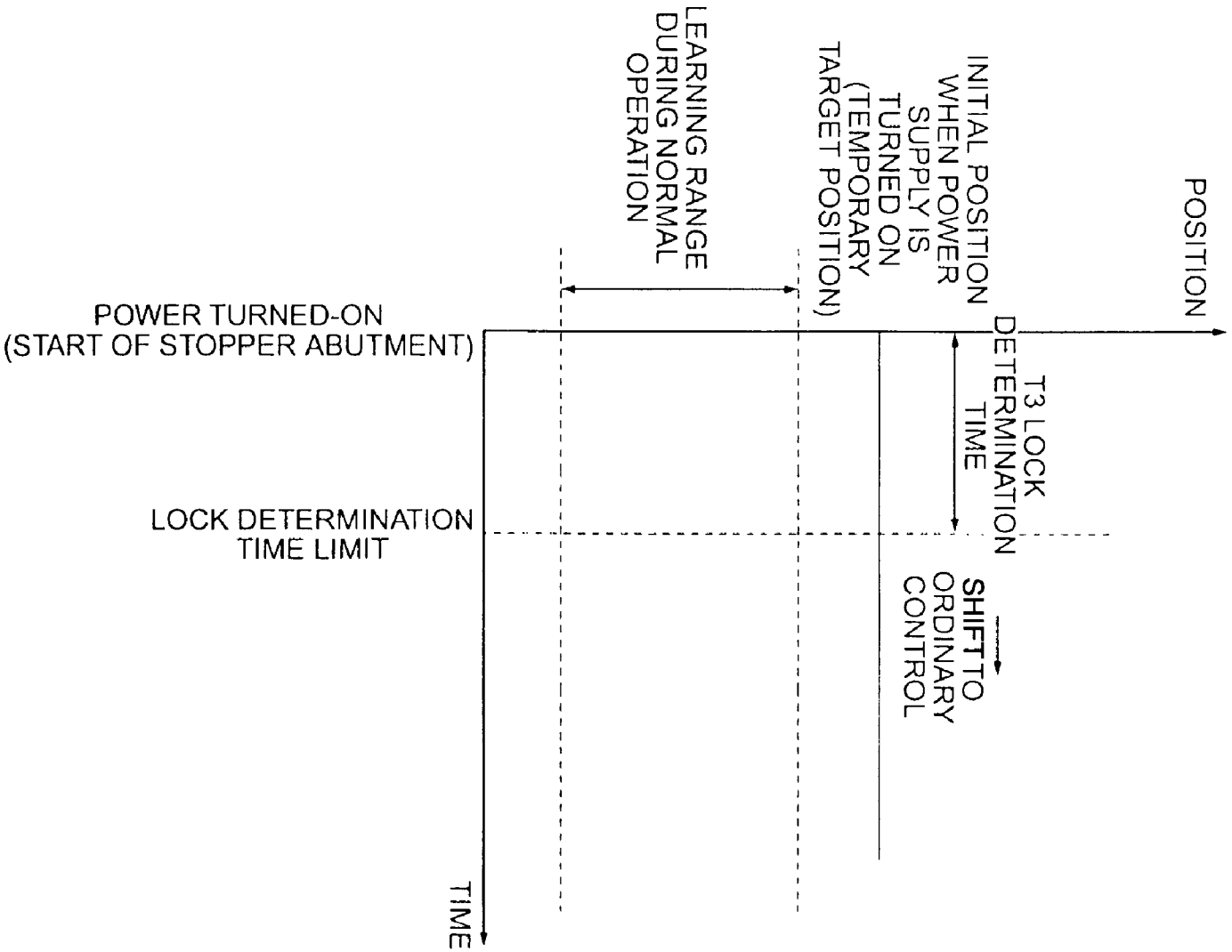

A positional change when the positioning object 101 is unable to be driven any more even though the temporary target position has been reached upon turning on of the power supply is shown in FIG. 8. In this case, since the initial position of the positioning object 101 is already the temporary target position thereof, it is determined immediately after the turning on of the power supply that the temporary target position has been reached, and reference position learning is started as it is. However, since it is impossible to drive the positioning object 101, the position of the positioning object 101 is calculated as a reference position after the lock determination time or duration T3 has elapsed. However, the thus calculated reference position is usually outside the area in which a normal reference position is obtained when the reference position learning is completed normally. Accordingly, it is determined that the reference position learning is invalid, and control is carried out by using a preset reference position which was set beforehand.

That is, in the initial state of the valve 205 upon turning on of the power supply, when the valve position is "outside the prescribed range", and when the valve 205 has reached the "temporary target" position, and when there is abnormality in the valve operation, the reference position calculated according to the reference position learning becomes "outside the prescribed range". On the other hand, when there is abnormality with the valve position being "in the prescribed range", the "temporary target" position can not be reached, and hence, when there is abnormality in the valve operation, it is determined as "the reference position learning being invalid".

Next, the respective steps of the reference position learning processing will be described according to the flow chart shown in FIG. 5. Every time the apparatus is in its initial state upon turning on of the power supply, the reference position learning has not yet been completed. In such a state, each flag and the counter are set as follows. That is, a learning completion flag is cleared to "0"; a temporary target arrival flag is also cleared to "0"; the target position is set to the "temporary target" position; and a lock determination counter is cleared to "0".

In step 501, it is determined whether the predetermined time T2 or more has elapsed after turning on of the power supply. When the predetermined time T2 has elapsed, the flow proceeds to step 517 where the learning processing is ended regardless of the state of progress of the reference position learning, and then control is shifted to the ordinary control. Details thereof will be described later. On the other hand, when the predetermined time T2 or more has not yet been elapsed, the flow proceeds to step 502 where it is determined whether the valve 205 has reached the temporary target position even once.

When the valve 205 has reached the temporary target position, the flow proceeds to step 503 where the reference position learning is carried out. Details thereof will be described later. On the other hand, when the temporary target position has not yet been reached, the flow proceeds to step 513 where it is determined whether the predetermined time T1 or more has elapsed after turning on of the power supply. This is to determine whether the valve 205 has not yet reached the temporary target position even if the predetermined time T1 has elapsed, and in other words, it is determined whether the valve driving environment is abnormal.

When it is determined in step 513 that the predetermined time T1 or more has elapsed after turning on of the power supply, the flow proceeds to step 510 where the reference position learning processing is ended, and then control is shifted to the ordinary control. Details thereof will be described later. On the other hand, when it is determined in step 513 that the predetermined time T1 or more has not yet been elapsed, the flow proceeds to step 514 where it is determined whether the current position of the valve 205 has reached the temporary target position. If the temporary target position has been reached, the flow proceeds to step 515 where the temporary target arrival flag is set to "1".

Thereafter, the flow proceeds to step 516 where the target position of the valve 205 is set to "0" in order to place the valve 205 into abutment against the stopper 206 in the reference position learning. Here, note that the stopper side direction of the target position is set as "0", and that the position of the stopper 206 is set to be greater than the valve position of "0". Then, the flow proceeds to step 505 where the current valve position is stored as the last valve position so as to determine a change in the valve position in the reference position learning, and the subroutine is ended.

When it is determined in step 514 that the temporary target has not yet been reached, the flow proceeds to step 505 where the current valve position is stored as the last valve position, and then the subroutine is ended.

In addition, when the position of the valve 205 has already reached the temporary target position even once in step 502, the flow proceeds to step 503 where the reference position learning is started. In step 503, it is determined whether the current valve position is the same as the last valve position stored. When they are different from each other, it is determined that the valve 205 is not in abutment with the stopper 206, and the flow proceeds to step 504, which is provided for accurately determining whether the valve 205 is locked against further movement. In step 504, the lock determination counter, which serves to determine that the valve 205 is locked when the state in which the valve position does not change continues for the predetermined time T3 or more, is cleared to "0". Thereafter, the flow proceeds to step 505 where the current valve position is stored as the last valve position, and the subroutine is ended.

When it is determined in step 503 that the current valve position is the same as the last valve position stored, a determination is made that the valve 205 is held in abutment against the stopper 206, and hence the valve position is unchanged. Then, the flow proceeds to step 506 where the lock determination counter is incremented by "1". Subsequently, the flow proceeds to step 507 where it is determined whether the same state of the lock determination counter continues for the predetermined time T3 or more. That is, a determination is made as to whether the state in which the current valve position is the same as the last valve position continues for the predetermined time T3 or more. When it does not continue for the predetermined time T3 or more, it is determined that the valve 205 has not yet been locked. Then, the flow proceeds to step 505 and the subroutine is ended.

When the above-mentioned state continues for the predetermined time T3 or more as a result of the determination in step 507, it is determined that the valve 205 is locked, and the flow proceeds to step 508 where the current valve position is set as a temporary reference position. Thereafter, the flow proceeds to step 509 where it is determined whether the temporary reference position thus set is outside the prescribed range. When the temporary reference position is outside the prescribed range, the flow proceeds to step 510 where the implemented reference position learning is made invalid and a preset value ×1 is set as a reference position. When the flow passed through step 510, or when the temporary reference position is not outside the prescribed range as a result of the determination in step 509, the flow proceeds to step 511 where the learning completion flag, which indicates the completion of the reference position learning, is set to "1". Thereafter, the flow proceeds to step 512 where the ordinary target position calculated in step 402 as shown in FIG. 4 is set as a formal target position, and the subroutine is ended.

Moreover, when it is determined in step 501 that the predetermined time T2 or more has elapsed after turning on of the power supply, the flow proceeds to step 517 where it is determined from the learning completion flag whether the reference position learning has already been completed. If it has been completed, the flow proceeds to step 512 and the subroutine is ended, whereas if it is not completed, the flow proceeds to step 510 where the reference position learning processing is compulsorily completed, and the subroutine is ended.

As described in the foregoing, according to the present invention, in learning a reference position, a control gain includes a first control gain, which serves to produce a large driving force and is used from the time when the power supply is turned on until the time when a positioning object reaches a temporary target position, and a second control gain, which serves to produce a small driving force and is used from the time when the positioning object has reached the temporary target position to the time when the reference position learning is carried out. Thus, by using the first control gain to provide a large driving force, it is possible for the positioning object to reach the temporary target position as quickly as possible from the turning on of the power supply, thereby reducing the time required for completing the reference position learning, whereas by using the second gain to provide a small driving force, the impact caused when the positioning object is brought into abutment against a stopper during the reference position learning can be reduced, thereby making it possible to prevent damage to the positioning control apparatus.

Moreover, a temporary target position is set in the reference position learning, and if the positioning object is unable to reach the temporary target position within a predetermined time, it is determined that it is impossible to perform the reference position learning in a correct manner for some reasons such as, for example, the occurrence of locking of the valve at its initial position after turning on of the power supply, failure of a driving unit for driving the positioning object, etc. In this case, a preset position is set as a reference position, thereby making it possible to avoid the mislearning of the reference position and shorten the time required until the completion of the reference position learning.

In addition, when the reference position learning has not been completed within the predetermined time, it is determined that it is impossible to perform the reference position learning in a correct manner for some reasons such as the defective adjustment of a driving wire for driving the positioning object. Thus, a preset position is set as a reference position. whereby it is possible to avoid the mislearning of the reference position and shorten the time required until the completion of the reference position learning.

Further, when the reference position obtained by the reference position learning is outside a prescribed range, it is determined it is impossible to perform the reference position learning in a correct manner for some reasons. In this case, a preset position is set as a reference position, thus making it possible to avoid the mislearning of the reference position.

Besides, the positioning object comprises a valve which is arranged in exhaust piping through which combustion gases from an engine installed on a vehicle are exhausted to the ambient atmosphere, the valve being driven and controlled by a driving means to adjust the exhaust pressure of the combustion gases in the exhaust piping, thereby controlling the output power of the engine. Accordingly, the present invention can be applied to a valve drive unit which is provided with a positioning control apparatus having a reference position learning function.

Although one embodiment of the present invention has been described above in detail, it goes without saying that the present invention is by no means limited to this embodiment but can be put into practice with various changes or modifications made therein without departing from the spirit and scope of the invention which is defined in the appended claims.

What is claimed is:

1. A positioning control apparatus comprising:

position detecting means for detecting the position of a positioning object;

target position generation means for generating a target position signal based on an output from said position detecting means; and driving means for driving said positioning object based on an output from said target position generation means;

wherein said target position generation means includes control means for setting a temporary target position of said positioning object, and learning a reference position of said positioning object with a control gain given to said driving means, said control gain comprising a first control gain, which is valid until the time when said positioning object reaches the set temporary target position, and a second control gain, which is smaller than said first control gain and which is valid after the time when said positioning object has reached the temporary target position until the reference position learning is completed.

2. The positioning control apparatus according to claim 1, wherein said control means operates to end the reference position learning when said positioning object has not yet reached said temporary target position within a predetermined time, and set a preset position as the reference position.

3. The positioning control apparatus according to claim 1, wherein said control means operates to set a preset position as the reference position when the reference position learning has not been completed within a predetermined time after said positioning object had reached said temporary target position.

4. The positioning control apparatus according to claim 1, wherein said control means operates to set a preset position as the reference position when said reference position generated by the reference position learning is outside a prescribed range.

5. The positioning control apparatus according to claim 1, wherein said positioning object is a valve which is drivably arranged in exhaust piping through which combustion gases from an engine installed on a vehicle are exhausted to an ambient atmosphere, said valve being driven and controlled by said driving means to adjust the exhaust pressure of the combustion gases in said exhaust piping thereby to control the output power of said engine.

6. A positioning control apparatus comprising:

a position detecting device for detecting the position of a positioning object;

a target position generation device for generating a target position signal based on an output from said position detecting device; and driving device for driving said positioning object based on an output from said target position generation device;

wherein said target position generation device includes a control device for setting a temporary target position of said positioning object, and learning a reference position of said positioning object with a control gain given to said driving device, said control gain comprising a first control gain, which is valid until the time when said positioning object reaches the set temporary target position, and a second control gain, which is smaller than said first control gain and which is valid after the time when said positioning object has reached the temporary target position until the reference position learning is completed.

7. The positioning control apparatus according to claim 6, wherein said control device operates to end the reference position learning when said positioning object has not yet reached said temporary target position within a predetermined time, and set a preset position as the reference position.

8. The positioning control apparatus according to claim 6, wherein said control device operates to set a preset position as the reference position when the reference position learning has not been completed within a predetermined time after said positioning object had reached said temporary target position.

9. The positioning control apparatus according to claim 6, wherein said control device operates to set a preset position as the reference position when said reference position generated by the reference position learning is outside a prescribed range.

10. The positioning control apparatus according to claim 6, wherein said positioning object is a valve which is drivably arranged in exhaust piping through which combustion gases from an engine installed on a vehicle are exhausted to an ambient atmosphere, said valve being driven and controlled by said driving device to adjust the exhaust pressure of the combustion gases in said exhaust piping thereby to control the output power of said engine.

* * * * *